United States Patent [19]

Lyman

[11] 4,033,058

[45] July 5, 1977

[54] PICTURE DISPLAY STAND

[75] Inventor: Geroge F. Lyman, Weston, Mass.

[73] Assignee: Data Packaging Corporation, Cambridge, Mass.

[22] Filed: Mar. 15, 1976

[21] Appl. No.: 667,132

Related U.S. Application Data

[63] Continuation of Ser. No. 536,815, Dec. 27, 1974, abandoned.

[52] U.S. Cl. ..... 40/97; 40/63 R

[51] Int. Cl.[2] ..... G09F 11/14

[58] Field of Search ..... 40/63, 64, 90, 97

[56] References Cited

UNITED STATES PATENTS

| | | | |
|---|---|---|---|
| 55,561 | 6/1866 | Walker | 40/78.09 |
| 172,328 | 1/1876 | Lauer | 40/90 |
| 483,312 | 9/1892 | Rudolph | 40/96 |
| 692,923 | 2/1902 | Shepard | 40/97 |
| 859,498 | 7/1907 | Hoover | 40/59 |
| 946,238 | 1/1910 | Townsend | 165/114 |
| 1,466,252 | 8/1923 | Shaw | 40/97 |
| 1,483,324 | 2/1924 | Baldwin | 40/97 |
| 1,849,049 | 3/1932 | Rand | 40/97 |
| 1,967,843 | 7/1934 | Sanders | 40/97 |
| 2,084,782 | 6/1937 | Storey et al. | 352/99 |
| 3,263,920 | 8/1966 | Reed | 235/117 |
| D. 142,502 | 10/1945 | Sherr | D6/234 |
| D. 172,216 | 5/1954 | Burrows | D6/234 |

FOREIGN PATENTS OR APPLICATIONS

| | | |
|---|---|---|
| 57,871 | 7/1911 | Switzerland |

*Primary Examiner*—John F. Pitrelli
*Assistant Examiner*—Robert F. Cutting
*Attorney, Agent, or Firm*—Wolf, Greenfield & Sacks

[57] ABSTRACT

A plurality of serially connected picture frames are arranged adjacent each other in a face-to-face series. Each frame is connected at a hinge line to the adjacent frames in the series. The hinges are arranged to enable the frames to be stacked flat against each other or to enable any adjacent pair of frames to be hinged apart to expose either of the opposite faces of any of the frames. The frames may be connected in an endless, belt-like configuration which may be mounted in a stand to enable the frames to be presented endlessly in sequence. Each of the frames is constructed to removably receive one or more pictures.

19 Claims, 18 Drawing Figures

FIG. 1
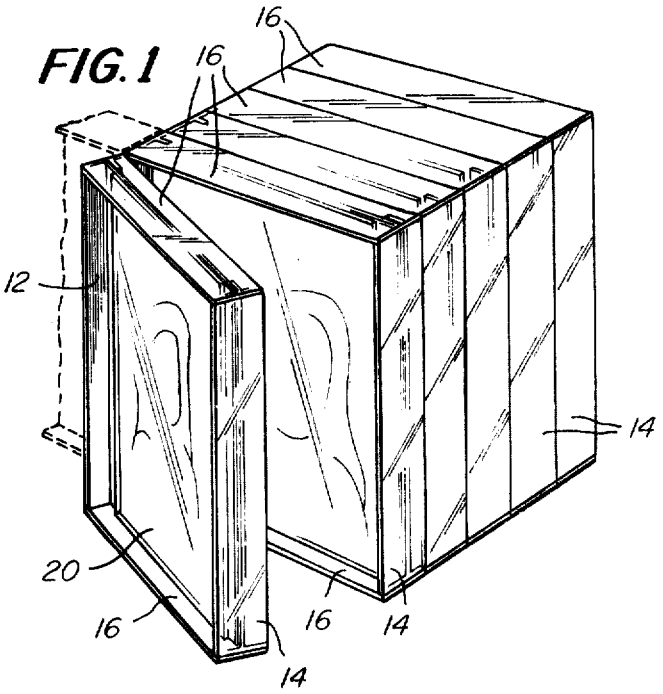
FIG. 3
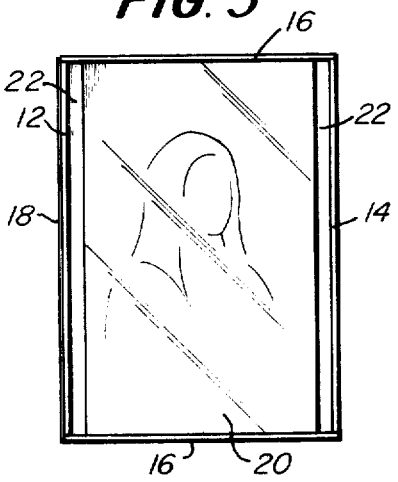
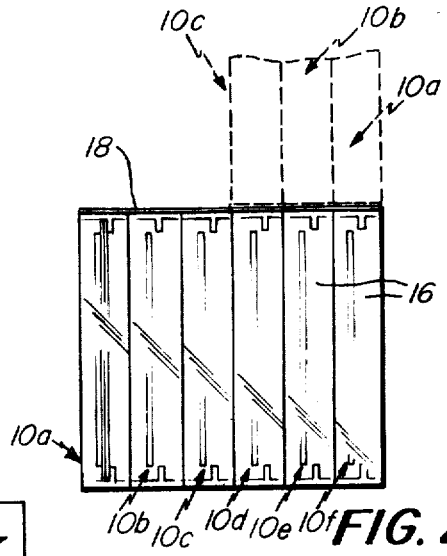
FIG. 2
FIG. 4
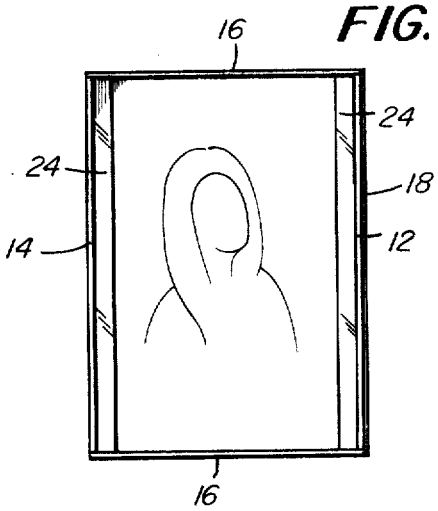
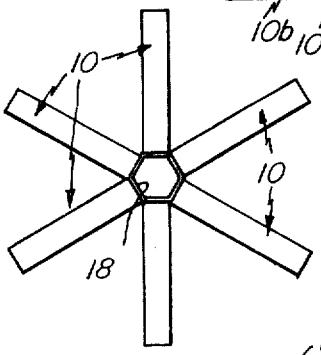
FIG. 5A
FIG. 5
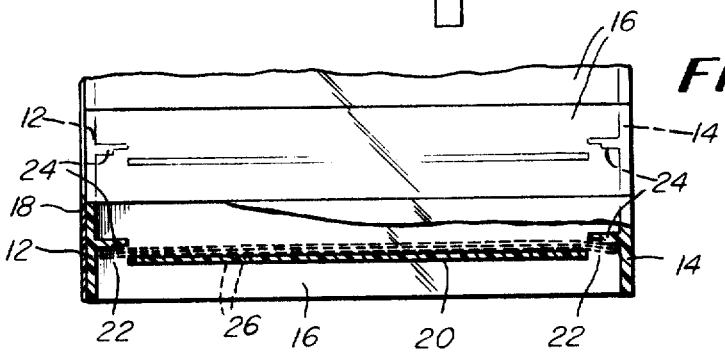

FIG. 13
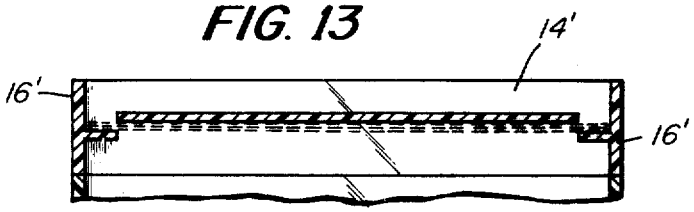
FIG. 14
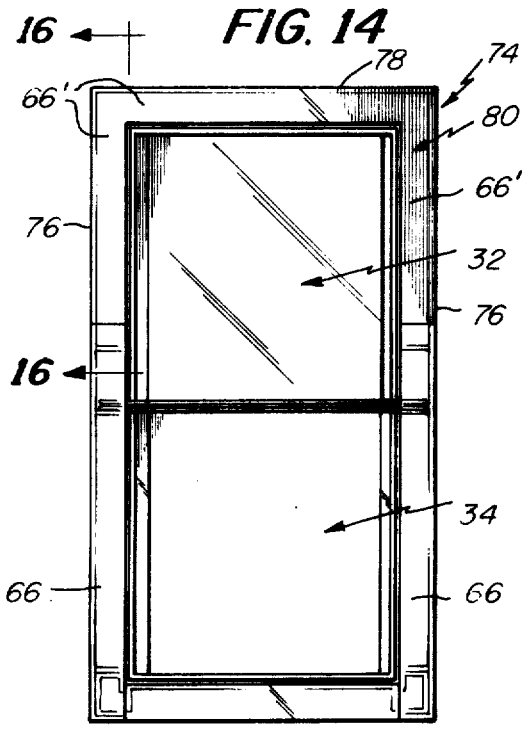
FIG. 15
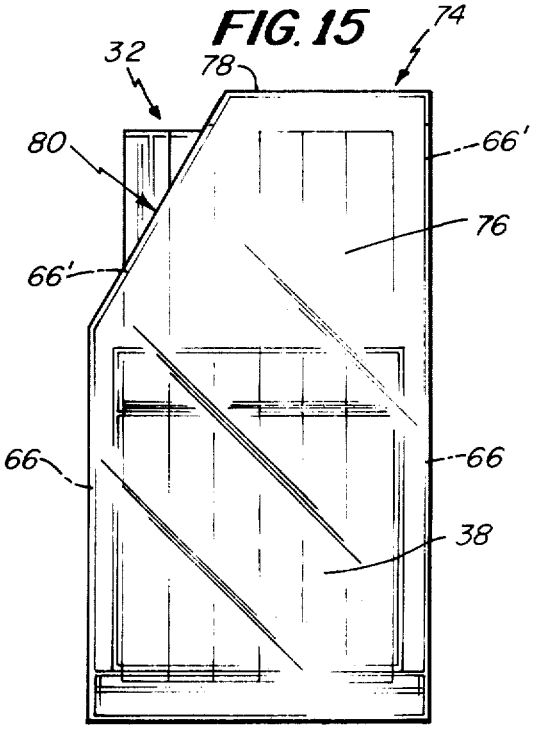
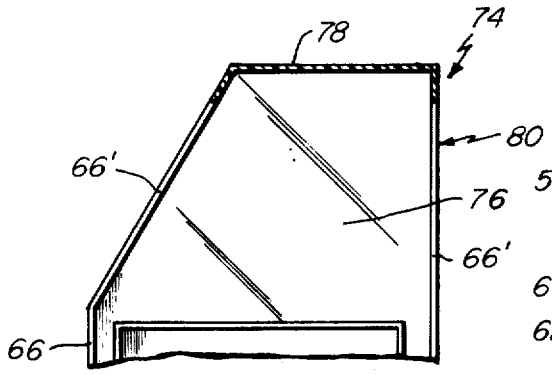
FIG. 16
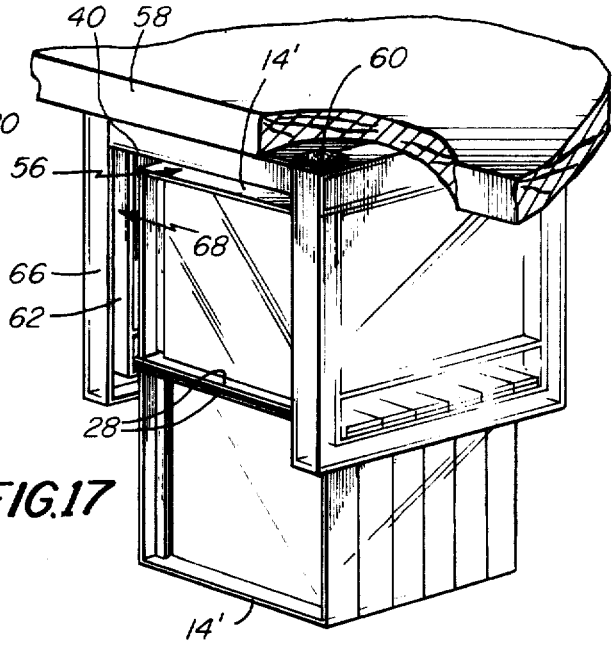
FIG.17

PICTURE DISPLAY STAND

This is a (continuation,) of application Ser. No. 536,815, filed Dec. 27, 1974, now abandoned.

BACKGROUND AND SUMMARY OF THE INVENTION

This invention relates to a display device for presenting selected of a plurality of pictures or similar articles in sequence. A variety of picture framing and displaying devices have been proposed and employed in the prior art. Among the more recent which has met with some success has been the "picture cube" having at least five faces made from a transparent material, such as plastic, and with means for mounting a picture against the inside surface of each of the cube faces so that the pictures may be displayed through the transparent faces. Among the limitations of such picture cubes is that they can only hold a limited number of pictures, usually five and in some instances six, in readiness for display. Thus, while the cube itself defines a substantial volume, the great proportion of the interior volume of the cube is not used and is unusable to store additional pictures in readiness for display. Also among the difficulties with the prior cube devices is that only one of the pictures can be viewed fully at the same time. While it is possible to view two or three of the sides of the cube at the same time, the view is not a full, direct view.

In accordance with the present invention, a substantially greater number of pictures can be retained in readiness for selective display than can be achieved with a conventional picture cube of similar volume and size. In addition, the present invention also enables two pictures to be viewed fully at the same time.

The invention utilizes a plurality of picture frames which are arranged in face-to-face abutting relation. Adjacent sides of adjacent frames are connected together by a hingelike connection and any pair of adjacent frames may be separated at the hinge line to expose fully the faces of the frames and the pictures exposed therein. Each frame also has means to removably receive a pair of pictures in back-to-back relation so that the pictures are exposed fully through the opposite faces of the frame.

In the invention, the frame sections are connected endlessly to define a belt-like configuration. The endlessly connected frames may be mounted on a support which enables the belt-like configuration to be advanced endlessly in one-frame increments. The belt-like arrangement is mounted to define a plurality of runs and in a manner which, when one of the frames is advanced from one run to the next run, all of the frames advance one incremental step.

It is among the objects of the invention to provide a picture displaying device which may contain a greater number of pictures in readiness for selective display than with prior devices of like volume and size.

A further object of the invention is to provide a device of the type described in which two pictures may be viewed fully and simultaneously.

A further object of the invention is to provide a device of the type described which enables incremental advancement of all of the plurality of frames toward a presentation position in response to advancement of one of the picture frames.

Still another object of the invention is to provide a device of the type described in which the pictures may be easily changed and replaced in the frames.

DESCRIPTION OF THE DRAWINGS

The foregoing and other objects and advantages of the invention will be understood more fully from the following further description thereof, with reference to the accompanying drawings wherein:

FIG. 1 is an illustration of an arrangement of frames used in the invention showing one of the frame sections slightly pivoted with respect to an adjacent frame;

FIG. 2 is a plan view of a plurality of frame sections arranged in face-to-face relation;

FIG. 3 is an elevation of one side of one of the frames;

FIG. 4 is an elevation of the opposite side of one of the frames;

FIG. 5 is a plan view of one of the frames in face-to-face relation, partly in section, to illustrate the picture mounting arrangement;

FIG. 5A is an illustration of an array of frames connected together in an endless configuration;

FIG. 13 is a sectional illustration of one of the frames as seen along the line 13—13 of FIG. 6;

FIG. 14 is a front elevation of a modified, hooded embodiment of the device shown in FIG. 6;

FIG. 15 is a side elevation of the device shown in FIG. 14;

FIG. 16 is an illustration of the device shown in FIG. 14 as seen along the line 16—16; and FIG. 17 is an illustration of the device of FIG. 6 mounted in an inverted configuration.

DESCRIPTION OF THE PREFERRED EMBODIMENT

Figure 6:
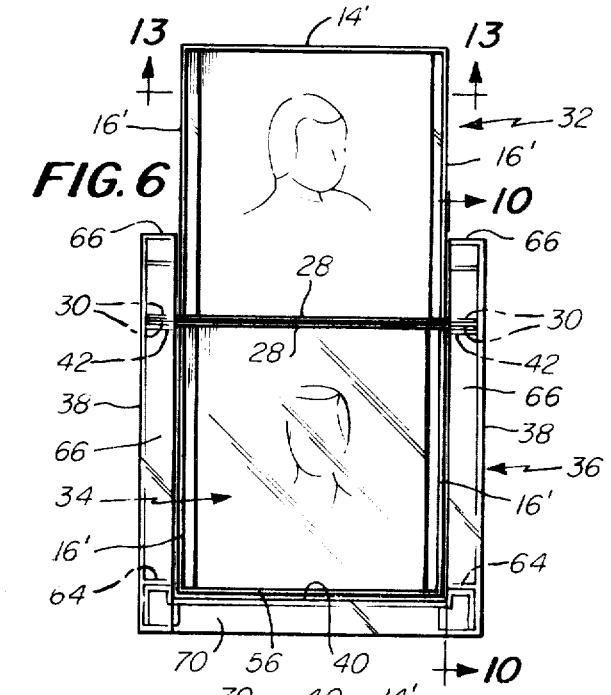
FIG. 6 is a front elevation of a preferred embodiment of the invention.

FIGS. 1 and 2 illustrate a preferred type of frame used in the invention which includes a plurality of frames 10 arranged in face-to-face, abutting relation. The frames 10 may be made from a variety of materials, such as plastic with a transparent plastic material being shown for purposes of illustration only. Each of the frames 10 may be of generally rectangular configuration having an inner frame section 12, an outer frame section 14 and a pair of connecting side frame sections 16. The inner frame sections 12 are of the same depth.

The frames 10 are connected together in a manner which enables the outer ends of any pair of adjacent frames to be pivoted away from each other as suggested in FIG. 1. This may be accomplished by one or more tape strips 18 adhesively attached to corresponding frame sections. Thus, as illustrated, the adhesive tape 18 may extend along the inner frame sections 12. The tape 18 should be highly adhesive and sufficiently strong to serve as a hinge between the adjacent, connected inner portion of the frames.

Each of the frame sections 10 includes means for removably holding a pair of photographs or the like in back-to-back relation so that the photographs may be exposed at the opposite faces of each of the frames. As shown in enlarged FIG. 5, the picture supporting means may include a transparent panel 20 secured at its ends to the opposing side frame sections 16. The width of the panel 20 is less than the interior width defined by the inner and outer frame sections 12, 14 thus leaving a space 22 between the side edges of the panel 20 and the inwardly facing surfaces of the frame sections 12, 14. Each of the frame sections 12, 14 has a flange extending along its length and projecting inwardly to overlap the spaces 22 between the side edges of the panel 20 and its associated frame sections 12, 14. The flanges 24 are offset slightly from the general plane of the panel 20. As shown in FIG. 5 a pair of photographs 26 may be arranged back-to-back and the opposite edges of the combined photographs may be slipped into the spaces 22 between the panel 20 and flanges 24 as suggested in phantom. The panel 20 and flanges 24 nerve the dual function of retaining the photographs in place as well as providing additional strength and rigidity for each of the frames. The foregoing frame structure also serves to protect the photographs by maintaining them well recessed within the center of the frame so that each of the frame sections defines a substantial and deep margin about its enclosed pictures. In addition, those of the frames which lie close against each other in a stack-like configuration abut against each other to enclose their respective photographs. Further, one of the photographs is protected by the transparent panel 20 itself.

The frames as illustrated in FIGS. 1–4 are hinged to each other so that any pair of adjacent frames may be pivoted apart 180° as suggested in phantom in FIGS. 1 and 2. With this arrangement it will be appreciated that the rear picture in one of the frames and the front frame in the next adjacent frame may both be exposed simultaneously and fully to the viewer. FIG. 2 illustrates in phantom the manner in which a pair of the more interior of the frames may be hinged apart to expose their respective forwardly and rearwardly facing pictures. Here, frames 10*c*, 10*d* have been hinged apart 180°, with frames 10*a*, 10*b* and 10*c* lying in one row and frames 10*d*, 10*e* and 10*f* lying in an adjacent, paralleling row. It may be noted also that in addition to exposing the pictures at the front face of frame 10*b* and rear face of 10*c*, the front picture in frame 10*a* as well as the rear picture in frame 10*f* also is exposed.

It may be appreciated from the foregoing that each of the six illustrated frames 10 in the group has two pictures therein so that the entire device may hold twelve pictures in a generally cubic volume. This is to be contrasted with a conventional "photo cube" in which five and perhaps six photographs could be held in readiness for display. In addition, when the frames are pivoted 180° as described above, two pictures will be displayed in substantially the same plane so that they may be viewed fully at the same time.

As mentioned above, the device is not limited to use in which it rests on its side frame section 16. The device also may be oriented so that the unhinged outer frame sections 14 serve as a base. When used in this attitude, the assembly of frames would rest on the outer sections 14 of those frames which have not been pivoted to an upwardly extending attitude. The pivoted, upwardly extending frames 10 rest on the inner frame sections 12 of the frames which still remain in the bottom row.

FIG. 5A suggests a modification of the embodiment described thus far in which the frames 10 are connected to each other in an endless configuration. Here, the tape strip 18 is arranged endlessly to connect the inner frame sections 12 of the frames at each end of the array, such as the frames 10*a* and 10*f*. With this embodiment, the frames may be free-standing in the manner described with regard to the embodiment of FIG. 1.

Figure 7:
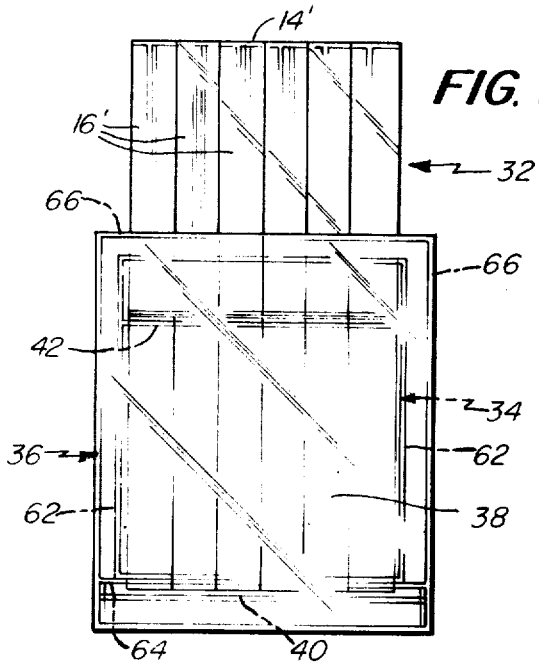
FIG. 7 is a side elevation of the embodiment shown in FIG. 6.
Figure 8:
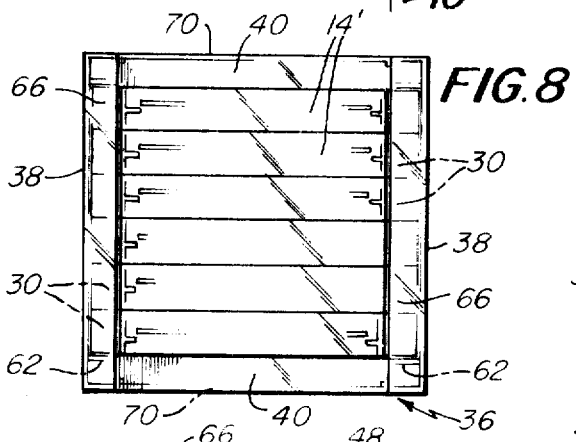
FIG. 8 is a top view of the embodiment shown in FIG. 6.
Figure 9:
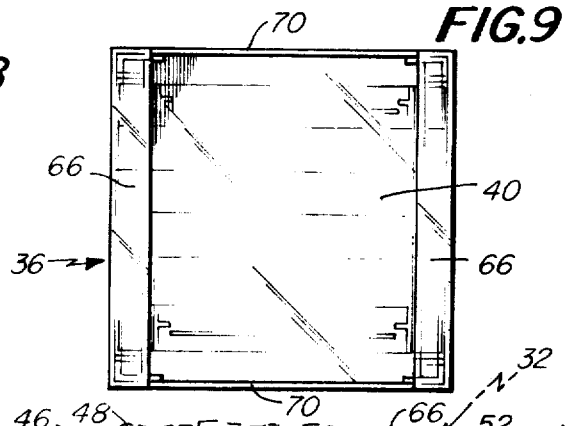
FIG. 9 is a bottom view of the embodiment shown in FIG. 6.
Figure 10:
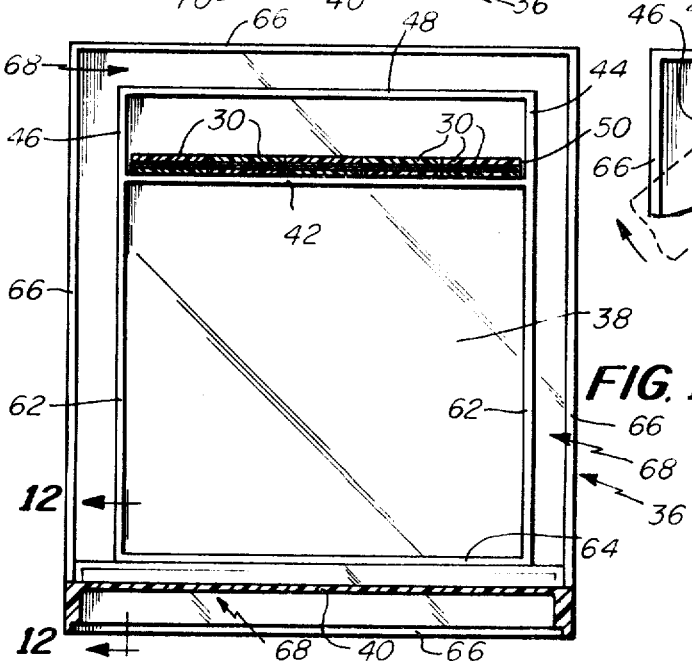
FIG. 10 is a sectional illustration as seen along the line 10—10 of FIG. 6.
Figure 11:
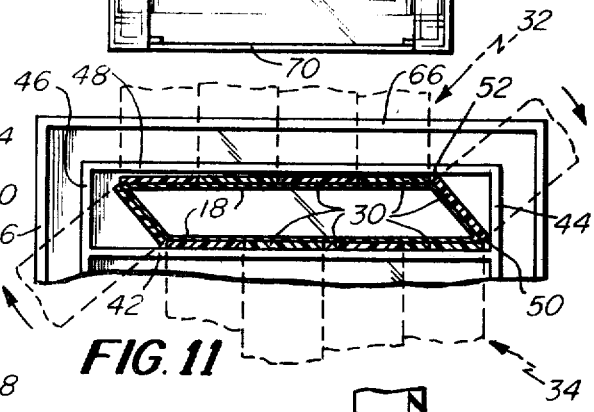
FIG. 11 is an illustration similar to FIG. 10 showing the manner in which the frames may be advanced endlessly in incremental sequence.

FIGS. 6–13 show a preferred embodiment of the invention which employs a plurality of frames 10 connected in the manner suggested in FIG. 5A to define an endless, belt-like configuration. In this embodiment, the array of endlessly connected frames is arranged to define a plurality of consecutive rows or runs in which the entire array of frames may be advanced in incremental, one-frame steps to advance each of the frames simultaneously to the next position. In this embodiment, each of the inner frame sections or inner portion 28 has a transversely extending projection 30 which preferably is flat and which defines substantially a continuation of its associated inner frame section 28. In the embodiment shown the device includes an even number of frames 10 which may be arranged to define an upper pack or group 32 and a lower pack or group 34, the frames in the upper group 32 being arranged in face-to-face relation as are the frames in the lower group 34. As shown in FIG. 10, the inner frame sections 28 of the upper group 32 lie generally edge-to-edge in a plane and rest flat on top of the inner frame sections of the lower group 34 of frames which also lie in a plane. When in this configuration, a pair of adjacent frames will be separated 180°, one of the frames being located in the upper group 32 and the other of the frames being located in the lower group. As shown in FIGS. 6 and 7, one face of each of the separated frames at the presentation end of the groups 32, 34 is exposed. In the embodiment shown, FIG. 6 may be considered as a view of the "presentation end" of the device which would be viewed, in FIG. 7 from the left side. It may be noted that the opposite end of the array of frames (the end as would be viewed from the right in FIG. 7) also could be considered as a presentation end except that here the photographs would appear in an inverted attitude.

The endlessly connected frames may be supported for belt-like incremental advancement by a generally U-shaped stand 36 having a pair of sidewalls 38 and an end wall 40. Each of the inwardly facing surfaces of the sidewalls 38 has a shelf 42 secured thereto and extending inwardly to support the projections 30 of the inner frame sections 28. Each of the shelves 42, at its forward end, is provided with an upwardly extending wall 44 and the two cooperate to confine and guard the projections 30. If desired, the rearward end of the shelf 42 also may be provided with an upwardly extending end wall 46 and a horizontal wall parallel to and spaced from the shelf 42 a distance slightly greater than the depth of the inner frame portions 28, the shelf 42, horizontal wall 48 and end walls 44, 46 define a rectangular opening.

In order to shift the position of each of the frames one frame increment and to present a new pair of pictures at the front, presentation end of the device, the forwardmost frame in the upper group 32 is gripped at its upwardly extending outer end and is simply rotated downwardly. The action of the belt-like configuration during this motion is suggested in FIG. 11 from which it may be seen that the forwardmost edge 50 of each of the projections 30 of the pivoting frame (the forwardmost frame in the upper group 32) will pivot against the front end wall 40 until the pivoting frame has advanced to a vertical position in which the projections 30 of the pivoting frame will lie flush against the end walls 44. It should also be noted that as the pivoting frame in the upper group 32 is pivoted forwardly and downwardly, the tape 18 which is then in the upper run is drawn upwardly and forwardly which causes the inner frame section 28 of the pivoted, most rearward frame in the lower group 34 to pivot upwardly toward the rear of the upper group. The inner frame sections 28 and connecting tape thus assume a generally parallelogram configuration which progressively approaches a rectangular configuration at which time the pivoting frame and pivoted frame have rotated through approximately 90°. Once the projections 30 at the front end of the device have been moved flush against the forward end walls 40, continued rotation of the pivoting frame causes the then upper edge 52 of the projections to slide downwardly along and pivot against the forward end wall 40. This, in turn, urges the projections 30 which lie flat on the shelves 42 to slide rearwardly on the shelves 42. When the pivoting frame has thus been rotated to the front end of the lower group 34, each of the frames in the device will have been advanced one incremental step and the frame which was at the rearward end of the lower group 34 has been advanced to the rearward end of the upper group. Thus, the device enables the belt and frames to be advanced in increments substantially equal to the depth of the inner portions of the frames and in which each such advancement enables the frame at the end of each of the runs to advance to the beginning of the next consecutive run.

From the foregoing, it should be understood that the rear end wall 46 and horizontal wall 48 are not strictly essential in order for the device to operate in the mode described above. However, it may be desirable to include the end wall 46 and horizontal wall 48 to contain the array of frames and to insure that they do not inadvertently separate from the support. In addition, by employing the rear end wall 46 and horizontal wall 48, the projections 30 of the inner frame sections 28 are enclosed fully within the rectangular arrangement of shelf 42, end walls 44, 46 and horizontal wall 48 which enables the support to be mounted in an inverted configuration, such as from the underside of shelf or the like. When employed in that attitude as suggested in FIG. 17, the horizontal wall 48 and end wall 46 would serve the same function as the shelf 42 and end wall 44 in the mode of operation described above. In addition, when employing the device in the inverted attitude, the presentation end would be reversed, i.e., it would be that end of the device which would be seen from the right in FIG. 7. Operating the device in this manner would not require changing the attitudes of the pictures within the frames.

Various constructions for the stand 36 may be employed. In each instance, it is important that the side walls 38 be spaced sufficiently to enable the frames and serially connected packs to advance freely therebetween and the distance between the shelf 42 and end wall 40 also should permit free movement of the frames within the U-shaped configuration of the stand 36 when the device is operated in its first described mode. It may be noted that when operated in the inverted mode shown in FIG. 17 in which the stand is suspended from an overhead support 54 the outer frame sections 14' of the frames within the U-shaped support will be spaced somewhat from the end wall 40 by an amount approximately equal to the distance between the shelf 42 and wall 48. This results from the fact that when in the inverted configuration, the endlessly connected inner sections rest on the horizontal wall 48. The remaining space 56 between the outer ends 14' of the frames within the U-shaped stand and the end wall 40 of the stand enables one's finger to be inserted to grip the forwardmost frame in the then uppermost group to rotate it downwardly to the then lower group. The device may be mounted to the underside of a support, as a shelf 58 by double face adhesive strips or pads as suggested at 60.

Figure 12:
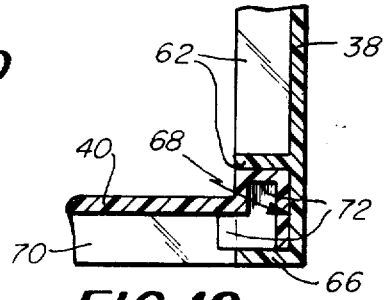
FIG. 12 is a sectional illustration as seen along the line 12—12 of FIG. 10.

If desired, the sidewalls 38 of the support 36 may include additional reinforcing ribs 62 secured to the inner surfaces of the sidewalls. In addition to serving to reinforce structure, the side ribs 62 preferably are disposed so that they will extend inwardly in close proximity to the nearest edge of the side frame section 16' at the end of the group within the U-shaped stand. This presents a pleasing appearance and also rigidifies the side wall. A horizontal reinforcing rib 64 also may be provided along the inside of the side wall 38 which extends from the lower end of each of the vertical reinforcing ribs 62. An additional peripheral flange 66 also may be formed within each sidewall 38 to extend inwardly as shown, the flange being spaced from and paralleling the side ribs 62, bottom rib 64 and horizontal wall 48 to define a channel 68. The end wall 40 of the U-shaped support which connects the sidewalls 38 may include front and rear flanges 70 and rectangularly shaped side members 72 which fit into the bottom portion of the channels 68 formed of the sidewalls as shown in FIG. 12.

The entire device may be made from various materials such as plastic which may be clear or opaque as desired.

FIGS. 14–16 illustrate a further embodiment of the invention in which a hood 74 is provided to enclose partially the upper group 32 of frames which would normally extend upwardly and out of the stand. In this embodiment, the various parts of the invention may be the same as those described with regard to the embodiment of FIG. 6 except that the sidewalls 38 have upwardly extending portions 76 which define the hood 74. The hood 74 includes an integral top wall 78. The forwardly facing portions 80 of the hood 74 may be inclined upwardly and rearwardly so that one or two of the frames at the forward, presentation end of the upper group are exposed and are easily grasped. If desired, the entire rear region of the device may be exposed through opening 80 or may be enclosed by a rear wall extending from the bottom of the stand to the top of the hood, the exposed embodiment being shown. The edges of the sidewalls 76 of the hood 74 preferably are provided with inwardly extending flanges 66' which define a continuation of the flanges 66 on the lower sidewall portions 38.

It should be understood that the foregoing description of the invention is intended merely to be illustrative thereof and that other embodiments and modifications may be apparent to those skilled in the art without departing from its spirit.

Having thus described the invention, what I desire to claim and secure by Letters Patent is:

1. A picture display device comprising:

a plurality of rectangular picture frames, each formed from a plurality of frame members;

hinge means connecting one of the frame members of each frame to a corresponding frame member of each adjacent frame;

a substantially flat, transparent panel extending across the face of each frame and being connected at its opposed ends to a pair of opposite frame member of each frame, the panel being contained within the region defined by the frame, the side edges of the panel being spaced from the other pair of opposite of said frame members; and a pair of ribs secured to each frame and extending adjacent each of the side edges of the panel, each of the ribs overlying one of the spaces defined between the side edges of the panel and said other opposite frame members, each of the ribs lying in a plane which is offset from that in which the panel is disposed, thereby enabling a pair of pictures to be removably retained within each frame and in back-to-back relation to expose each of said pictures at opposite faces of each of the frames.

2. In a picture display device including means defining an endless belt having a plurality of consecutive runs, the improvement comprising:

a plurality of picture holding frames, each frame including an inner portion of uniform depth, each frame being connected at its inner portion thereof to the belt and extending outwardly from the belt, the frames being constructed and arranged so that in each run of the belt said connected inner portions of said frames lie adjacent each other in substantially full edge-to-edge relation and in generally the same plane, the connected inner portions of the frames being of substantially the same depth; and each of the runs including a plurality of said frames; and supporting means for supporting the assembly of frames and the belt means to enable the advancement of the belt and frames in increments substantially equal to said depth and in which each incremental advancement will enable the frame at the end of each of the runs to advance to the beginning of the next consecutive run, said supporting means, belt and frames being constructed and arranged so that all of the frames in each of the runs will advance one increment in response to advancement of a frame from its end position in one run to its beginning position in the next consecutive run.

3. A picture device comprising:

means defining an endless belt having a plurality of consecutive runs;

a plurality of picture holding frames, each connected at an inner portion thereof to the belt and extending outwardly from the belt, the frames being constructed and arranged so that in each run of the belt, said connected inner portions of the frames may lie in generally the same plane;

supporting means for supporting the assembly of frames and the belt means to enable the frame at the end of each run to be advanced to the beginning of the next consecutive run, said frames and supporting means being constructed and arranged so that all of the remaining frames in each run will advance to their next successive positions in that run in response to advancement of a frame from the end of one run to the beginning of the next consecutive run;

each of the connected inner portions of the frames being flat and having at least a portion which lies edge-to-edge with a corresponding inner portion of each adjacent frame;

hinge means connecting the adjacent edges of adjacent flat inner portions of adjacent frames to define the endless belt;

the means for supporting the belt-like arrangement of frames comprising:

each of said connected inner portions of the frame sections having laterally extending projections which protrude beyond the sides of the frames; a support including a shelf on each side of the frame and belt assembly, each shelf being located to support the laterally extending projections of the connected inner portions; and an end wall extending upwardly from at least one end of at least one of the shelves.

4. A device as defined in claim 3 wherein the support further comprises:

the support being of generally U-shaped configuration and having a pair of sidewalls and an end wall connecting the sidewalls, the shelves being located at the opposite ends of the sidewalls.

5. A device as defined in claim 4 further comprising:

each shelf having end walls at each end thereof; and a second shelf parallel to said first mentioned shelf and connecting the end walls to define a generally rectangular opening to receive the laterally extending portions of the frames.

6. A device as defined in claim 4 wherein the U-shaped configuration defined by the end wall and sidewalls of the support defines a region larger than that defined by the frames to enable the frames to pass freely and longitudinally through the channel defined by the U-shaped support.

7. A device as defined in claim 5 wherein the parallel shelf is spaced from the first mentioned shelf a distance slightly greater than the depth of each of the inner frame sections.

8. A frame construction for retaining a pair of photographs comprising:

a plurality of frame sections connected to each other in generally rectangular configuration;

a transparent panel connected at its ends to opposite sections of the frame, each of the panels lying within the region defined by the frame, the sides of the panel being spaced from corresponding frame sections; and a rib secured to the frame on each side of the panel, each of the ribs overlying the space between the panel and the side sections, each of the ribs lying in a plane which is offset from that of the panel.

9. A picture display device comprising:

a plurality of rectangular picture frames, each formed from a plurality of frame members, each of the frames being of substantially the same dimensions, each of the frame members being of a predetermined depth, said frames being arrangeable in face-to-face, abutting relation;

hinge means serially connecting one of the frame members of each frame to a corresponding frame member of each adjacent picture frame;

means disposed interiorly of each of the picture frames for removably retaining a pair of pictures and for displaying the retained pictures at opposite faces of the frames;

the depth of each of the picture frames being greater than the depth of the means for retaining and displaying said pictures whereby when a plurality of said picture frames are arranged in face-to-face relation, the facing frames will abut each other and will enclose each of the pictures retained therein.

10. A picture display device comprising:

means defining an endless belt having a plurality of consecutive runs;

a plurality of picture frames, each connected at inner portions thereof to the belt and extending outwardly from the belt, the picture frames being arranged so that in each run of the belt, the connected sides of the picture frames will lie in generally the same plane;

each of said runs including a plurality of said picture frames;

a support having a pair of spaced sidewalls and means for connecting the sidewalls; and means for supporting the assembly of picture frames and the belt means from the sidewalls of the support to enable the belt and picture frames to be advanced in increments between the sidewalls, one of the runs passing between the sidewalls and the other of the runs passing outwardly of the sidewalls.

11. A picture display device as defined in claim 10 further comprising:

said consecutive runs of said endless belt being two in number and being parallel to each other;

said support being generally U-shaped, said means connecting the sidewalls of said support comprising an end wall connected to each of the sidewalls.

12. A picture display device as defined in claim 11 further comprising:

said belt, picture frames and means for supporting the assembly of picture frames and belt means being constructed and arranged so that the picture frames in one of the said runs rest on top of the picture frames in the other of said runs.

13. A picture display device as defined in claim 10 further comprising:

each of said picture frames being of rigid construction;

said means defining said endless belt comprising hinge means connecting said connected inner portions of said picture frames to each other.

14. A picture display device as defined in claim 13 further comprising:

each of the outwardly extending portions of the picture frames, in each run, extending substantially perpendicular and outwardly from the endless belt portion of that run.

15. A picture display device as defined in claim 14 further comprising:

the frames in each of said runs being arranged serially and lying flat against each other in face-to-face abuttment.

16. A picture display device comprising:

a plurality of picture frames;

hinge means connecting an inner portion of each picture frame to the corresponding inner portion of each adjacent picture frame, the hinged picture frame inner portions being connected in an endless configuration, the picture frames and hinge means being constructed and arranged so that the picture frames may be arranged in a pair of serially connected packs and in a presentation configuration in which the picture frames in each pack lie against each other in face-to-face abuttment, and in which the inner portions of the frames in one pack rest against the inner portions of the frames in the other pack;

means for supporting the picture frames in said arrangement of serially connected packs, said support means being constructed to enable simultaneous advancement of a picture frame from an end of each of the packs to the adjacent end of the next adjacent pack in the series;

said picture frames, hinge means and support means being constructed and arranged to cause said simultaneous advancement of said picture frames in response to advancement of one of said picture frames.

17. A picture display device comprising:

a plurality of picture holding frames hingedly connected to each other at a side thereof in an endless, belt-like array and defining a plurality of runs, the frames being constructed and arranged so that in each run, the hinged sides of the frames may lie in generally the same plane;

each of the connected sides of the frame sections having a laterally extending projection;

means for supporting said laterally extending projections of the frames, said supporting means being constructed and arranged to confine movement of said laterally extending projections in a manner to enable the frame at the end of each run to be advanced to the beginning of the next succeeding run;

said frames, projections and support means being constructed and arranged so that all of the remaining frames in each run will advance to their next succeeding position in their respective runs in response to advancement of a frame from the end of one run to the beginning of the next run.

18. A picture display device as defined in claim 17 further comprising:

said connected inner portions of said frame and said laterally extending portions being substantially flat and being of substantially the same depth.

19. A picture display device as defined in claim 17 wherein there are two parallel runs and further comprising:

said frames and supporting means being constructed and arranged to support the frames in a display position in which each of the frames is located within one of the runs;

said frames and supporting means being further constructed and arranged so that the hingedly connected inner portion of the frames in one run will lie against the hingedly connected inner portions of the frames in the other run when the device is in said display position.

* * * * *